US009281627B2

(12) United States Patent
Fujiwara

(10) Patent No.: US 9,281,627 B2
(45) Date of Patent: Mar. 8, 2016

(54) DEVICE CONNECTOR WITH IMPROVED OPERABILITY WHEN CONNECTING HARNESS-SIDE TERMINALS AND DEVICE-SIDE TERMINALS

(71) Applicant: Sumitomo Wiring Systems, Ltd., Yokkaichi, Mie (JP)

(72) Inventor: Michiyo Fujiwara, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/572,058

(22) Filed: Dec. 16, 2014

(65) Prior Publication Data

US 2015/0194769 A1 Jul. 9, 2015

(30) Foreign Application Priority Data

Jan. 8, 2014 (JP) ..... 2014-01965

(51) Int. Cl.
*H01R 13/648* (2006.01)
*H01R 13/6581* (2011.01)
*H01R 4/34* (2006.01)

(52) U.S. Cl.
CPC ..... *H01R 13/6581* (2013.01); *H01R 4/34* (2013.01)

(58) Field of Classification Search
CPC ..... H01R 13/658; H01R 4/34; H01R 13/5208
USPC ..... 439/607.04, 801, 587
See application file for complete search history.

(56) References Cited

U.S. PATENT DOCUMENTS 6,991,494 B1 * 1/2006 Spink, Jr. ..... H01R 13/745 439/607.27
7,811,116 B2 * 10/2010 Sakakura ..... H01R 4/302 439/364
8,152,574 B2 * 4/2012 Matsuoka ..... H01R 4/302 439/587
8,342,880 B2 * 1/2013 Kato ..... H01R 9/032 439/382
8,545,265 B2 * 10/2013 Sakamoto ..... B29C 45/14 439/606
9,059,534 B2 * 6/2015 Endo ..... H01R 13/52
2001/0029120 A1 * 10/2001 Miyazaki ..... H01R 13/65802 439/98
2005/0245132 A1 * 11/2005 Huang ..... H01R 13/6275 439/607.04
2010/0255728 A1 10/2010 Matsuoka et al.
2014/0120767 A1 * 5/2014 Itsuki ..... H01R 13/5208 439/587
2014/0322973 A1 * 10/2014 Okamoto ..... H01R 13/521 439/587

* cited by examiner

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A device connector includes device-side terminals (18), a device-side shield shell (21), harness-side terminals (40) to be fixed to a plurality of wires (71) and connected to the device-side terminals (18) by bolts (69) and a harness-side shield shell (50) connected to a braided wire (72) surrounding the wires (71). The harness-side shield shell (50) includes a first shell (51) and a second shell (61). The first shell (51) is fixed to the braided wire (72) and includes an operation cutout (60) for enabling a connecting operation of the device-side terminals (18) and the harness-side terminals (40) by the bolts (69). The operation cutout (60) is closed by the second shell (61).

7 Claims, 9 Drawing Sheets

DEVICE CONNECTOR WITH IMPROVED OPERABILITY WHEN CONNECTING HARNESS-SIDE TERMINALS AND DEVICE-SIDE TERMINALS

BACKGROUND

1. Field of the Invention

The invention relates to a device connector.

2. Description of the Related Art

US Patent Application Publication No. 2010/0255728 discloses a device connector for connecting a harness-side connector mounted on an end of a wiring harness to a device-side connector provided in a device. The wiring harness is formed by collectively covering a plurality of wires with a shield member. The harness-side connector includes a second housing for accommodating second terminals fixed to end parts of the wires and a second shield shell for surrounding the second housing. The second shield shell is fixed to the shield member and relatively movable with respect to the second housing.

The device-side connector includes first terminals, a first housing for holding the first terminals and a first shield shell for surrounding the first housing and the first terminals. In connecting the harness-side connector and the device-side connector, the first housing is connected to the second housing. The second shield shell is moved away from the housings so as not to hinder a bolting operation of the first and second terminals. When the second shield shell is moved, the shield member fixed to the second shield shell must deformed resiliently, but the second shield shell returns in a direction toward the housings due to a resilient restoring force of this shield member. Thus, the second shield shell hinders the bolting operation.

The invention was completed based on the above situation and improve operability when connecting harness-side terminals and device-side terminals.

SUMMARY OF THE INVENTION

The invention is directed to a device connector, including a device-side housing configured to hold a plurality of device-side terminals. A device-side shield shell is mounted on the device-side housing. The device connector further has wires constituting a wiring harness. Harness-side terminals are fixed to the wires and are connected to the device-side terminals. A harness-side housing is connectable to the device-side housing and is configured to hold the harness-side terminals. A shielding layer is configured to surround the wires. A harness-side shield shell is connected to the shield shell and is configured to surround the harness-side housing. The harness-side shield shell includes first and second shells. The first shell is to be fixed to the shielding layer and includes an operation cutout for enabling a connecting operation of the device-side terminals and the harness-side terminals by the bolts. The second shell is mounted on the first shell or the device-side shield shell while closing the operation cutout.

The harness-side terminals may be connected to the respective device-side terminals by tightening one or more bolts. The at least one operation cutout enables the connecting operation of the device-side terminals and the harness-side terminals by the one or more bolts.

The shielding layer may comprise comprises at least one braided wire formed by braiding metal strands substantially into a tubular shape.

The first shell may be fixed to the shielding layer.

The device connector may include means formed on the harness-side housing for holding the first shell assembled with the harness-side housing. Accordingly, an operation of connecting the harness-side housing to the device-side housing and an operation of arranging the first shell at a position connectable to the device-side shield shell can be performed in one action.

The first shell and the device-side shield shell may include means for fixing the first shell and/or the device-side shield shell in a state where the harness-side housing is connected to the device-side housing and the second shell is detached from the first shell. Accordingly, there is no possibility of hindering a connecting operation of the device-side terminals and the harness-side terminals since the harness-side housing and the device-side housing are held connected during the connecting operation of the terminals.

The harness-side housing initially is connected to the device-side housing when connecting the device-side terminals and the harness-side terminals. The braided wire is not deformed forcibly if the first shell is arranged to correspond to the harness-side housing. The second shell is detached in this state, and the operation cutout is open. The terminals are connected via the operation cutout by tightening the bolts in the operation cutout so that the harness-side terminals are connected to the device-side terminals. The second shell is mounted to close the operation cutout after the harness-side terminals and the device-side terminals are connected so that a shielding function is maintained. Thus, since the braided wire need not be deformed forcibly when connecting the harness-side terminals and the device-side terminals by bolting, and operability in connection by bolting is good.

These and other objects, features and advantages of the invention will become more apparent upon reading the following detailed description of preferred embodiments and accompanying drawings.

DETAILED DESCRIPTION

Figure 1:
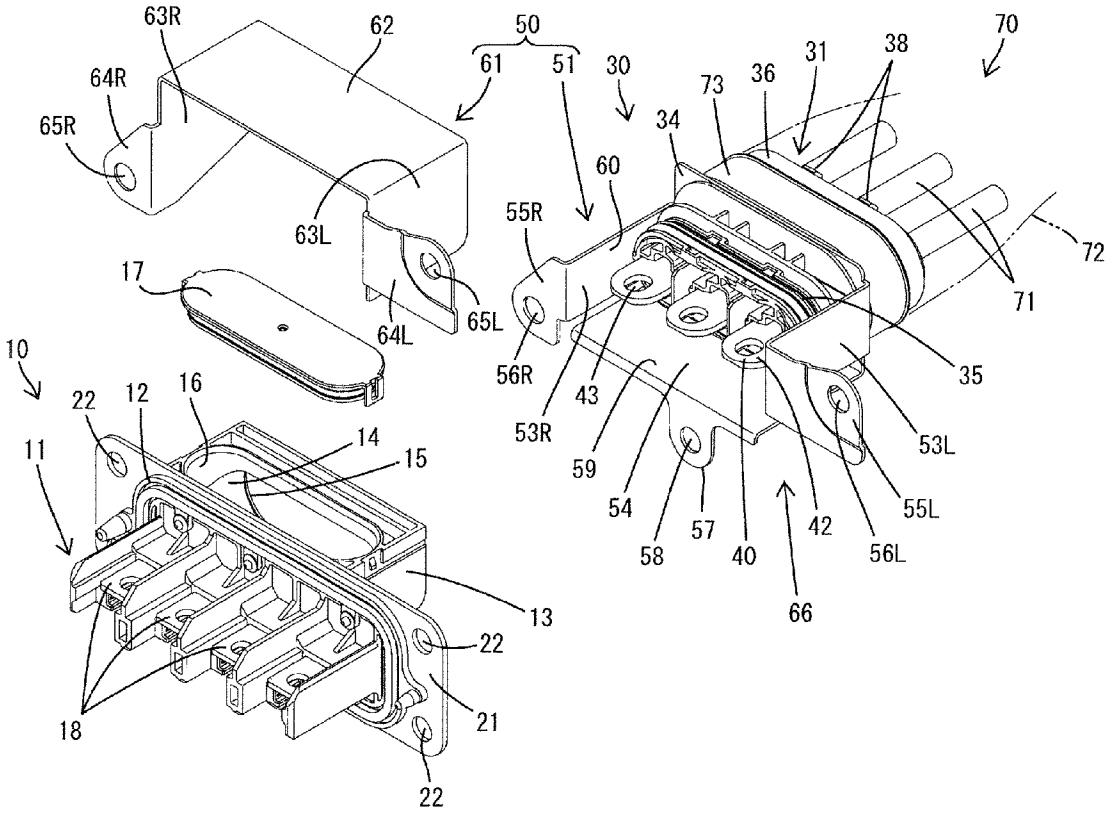
FIG. 1 is a perspective view showing a state where a harness-side housing and a device-side housing are separated in one embodiment.
Figure 4:
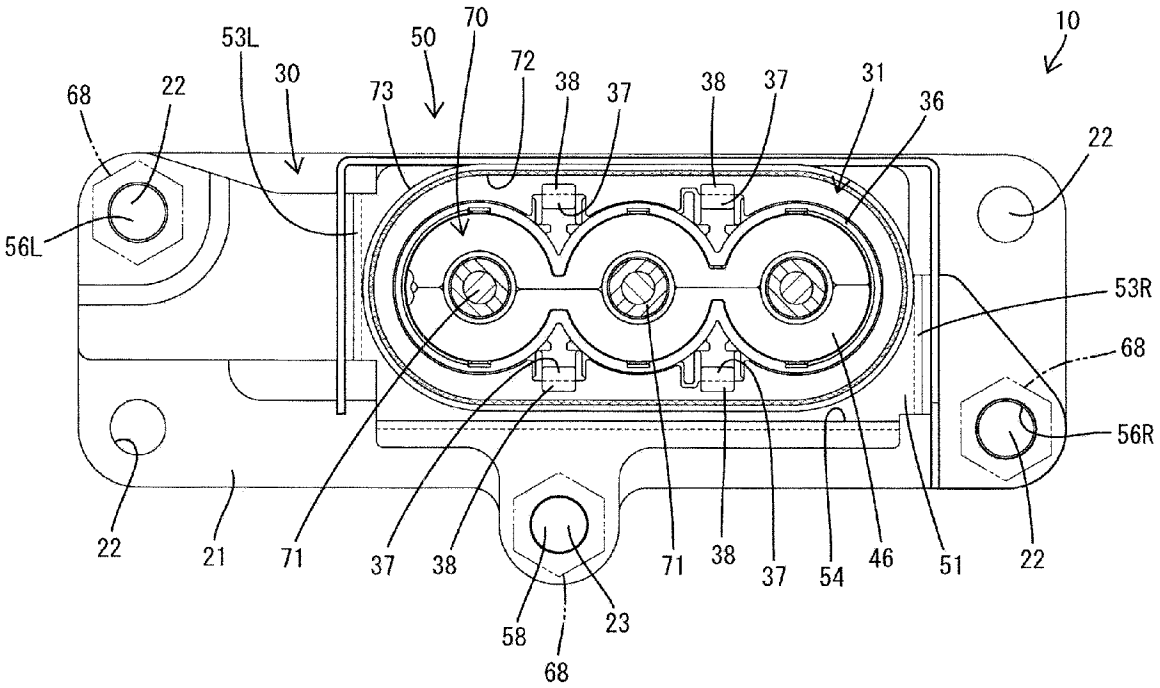
FIG. 4 is a front view in section showing a state where a device-side connector and the harness-side connector are connected.
Figure 5:
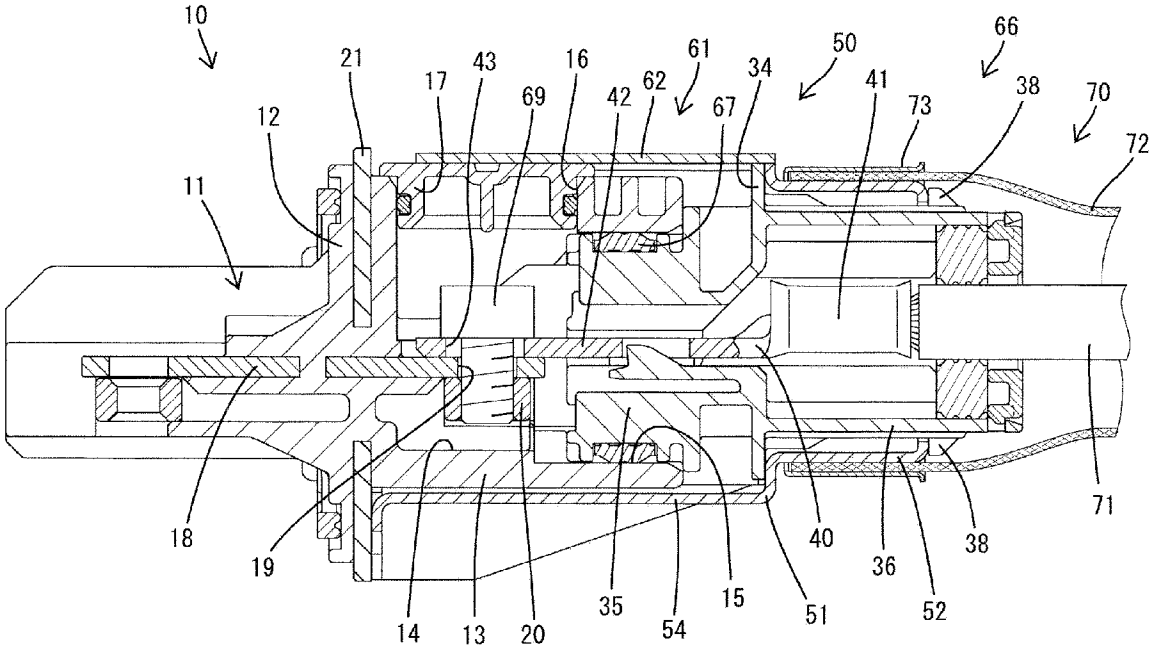
FIG. 5 is a side view in section showing the state where the device-side connector and the harness-side connector are connected.
Figure 6:
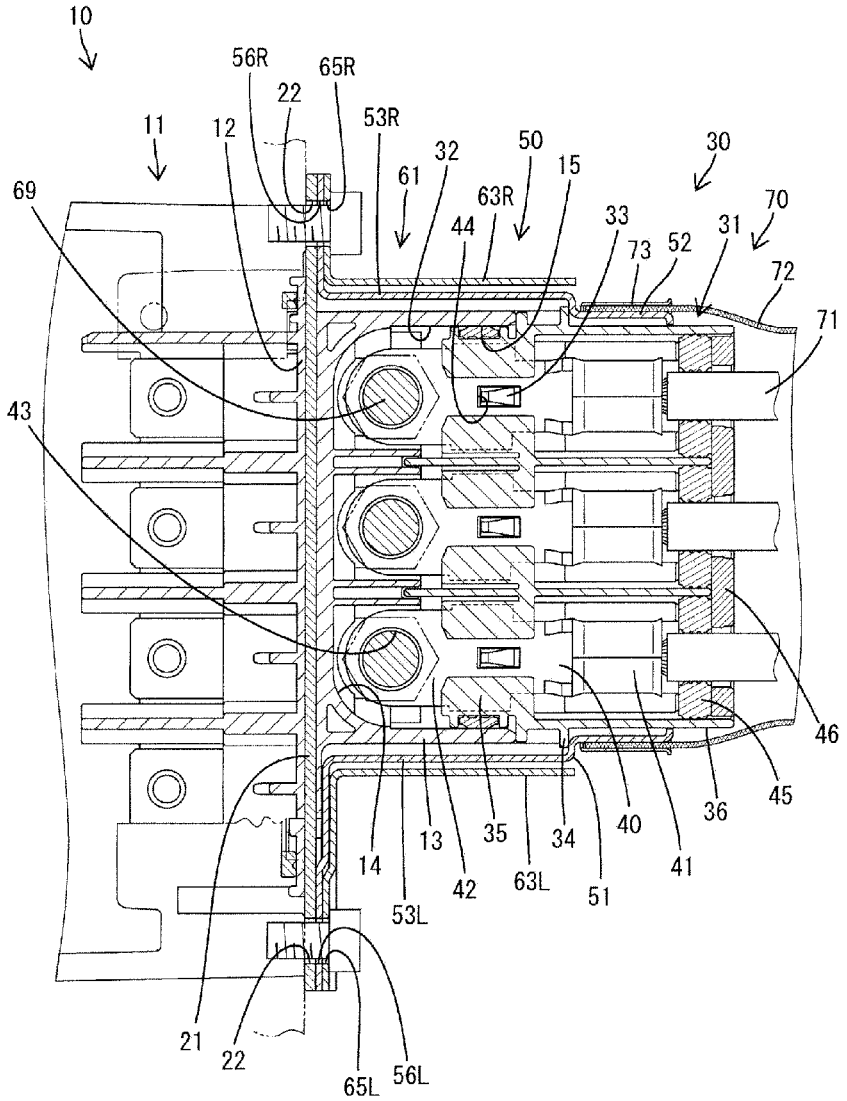
FIG. 6 is a plan view in section showing the state where the device-side connector and the harness-side connector are connected.

A device connector in accordance with the invention is identified generally by the numeral 10 in FIGS. 1 and 4-7. The device-side connector 10 is to be fixed to various devices (not shown) e.g. mounted in an automotive vehicle and is connectable with a harness-side connector 30, as shown in FIGS. 1, 5 and 6. Note that, in the following description, a side facing the harness-side connector 30 is defined to be a front side concerning a front-back direction of the device-side connector 10 and a side facing the device-side connector 10 is defined to be a front side concerning a front-back direction of the harness-side connector 30.

As shown in FIGS. 5 and 6, the device-side connector 10 includes a device-side housing 11 made e.g. of synthetic resin and device-side terminals 18 to be mounted in the device-side housing 11. At least one device-side shield shell 21 made of conductive material such as metal is mounted on the device-side housing 11. The device-side housing 11 includes a supporting wall 12 and a box-shaped portion 13 projecting forward (rightward in FIGS. 5 and 6) from the supporting wall 12. The interior of the box-shaped portion 13 serves as a terminal accommodation space 14 that is open on upper and front surfaces.

A connection opening 15 is formed on the front surface of the terminal accommodation space 14 and the harness-side housing 31 can be fit therein to insert harness-side terminals 40 into the terminal accommodation space 14. An operation opening 16 is formed on the upper surface of the terminal accommodation space 14 and is used to connect the device-side terminals 18 and the harness-side terminals 40 by bolting. A cap 17 provided with a sealing function is attached to and detached from the operation opening 16.

The device-side terminal 18 is a narrow substantially flat plate that is long in the front-back direction. Device-side terminals 18 are supported on the supporting wall 12 while penetrating through the supporting wall 12 in the front-back direction. The device-side terminals 18 are arranged side by side in a lateral direction (i.e. direction intersecting with a connecting direction of the device-side housing 11 and the harness-side housing 31) in a state where plate surfaces thereof extend horizontally. Rear parts of the device-side terminals 18 are connected to circuits and the like of the device. Front end parts of the device-side terminals 18 are accommodated side by side in the terminal accommodation space 14. A device-side mounting hole 19 penetrates the front end part of the device-side terminal 18 in a vertical direction (i.e. direction parallel to a plate thickness direction of the device-side terminal 18). A nut 20 is fixed to the lower surface of the device-side terminal 18 by being press-fit into a resin part projecting from the supporting wall 12 and is arranged coaxially with the device-side mounting hole 19.

Figure 7:
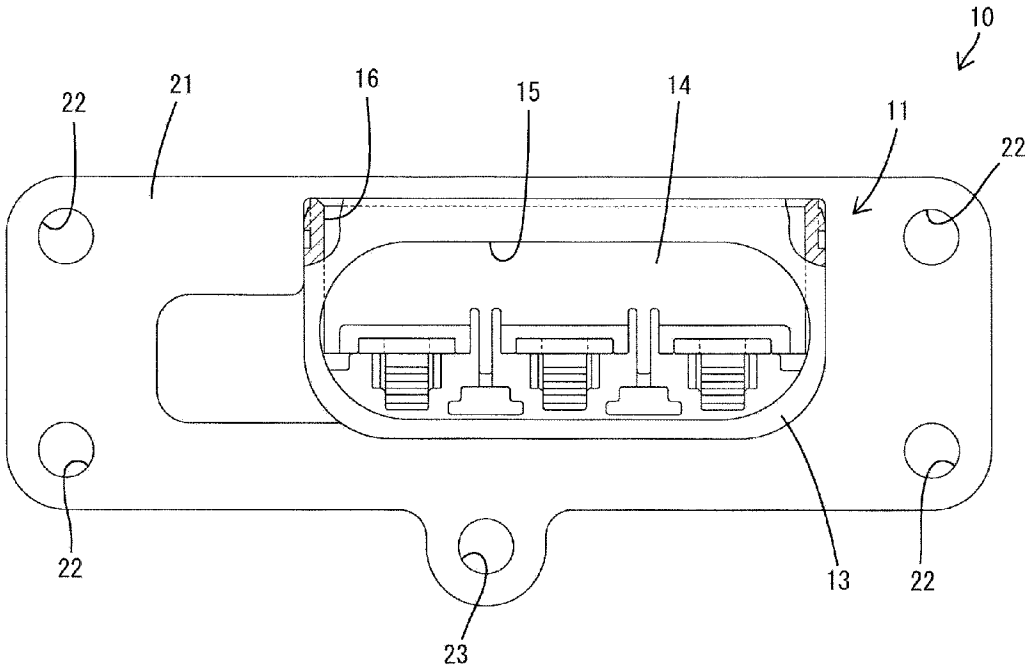
FIG. 7 is a front view partly in section of the device-side connector.
Figure 8:
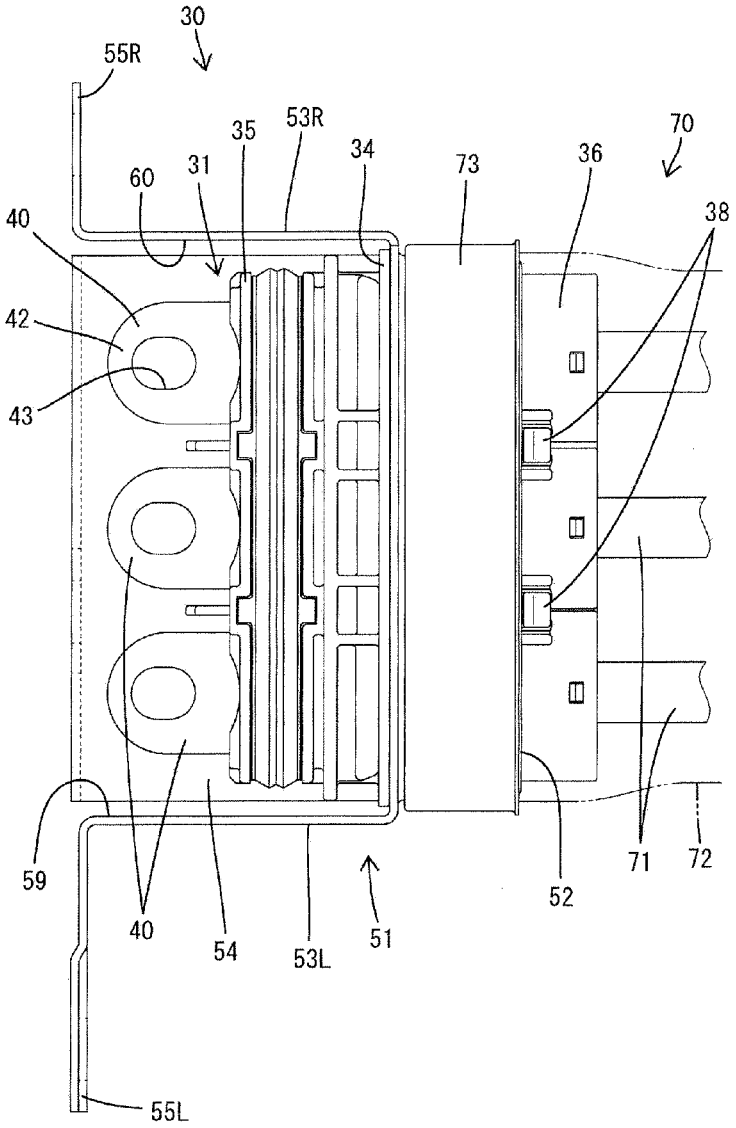
FIG. 8 is a plan view of the harness-side connector.
Figure 9:
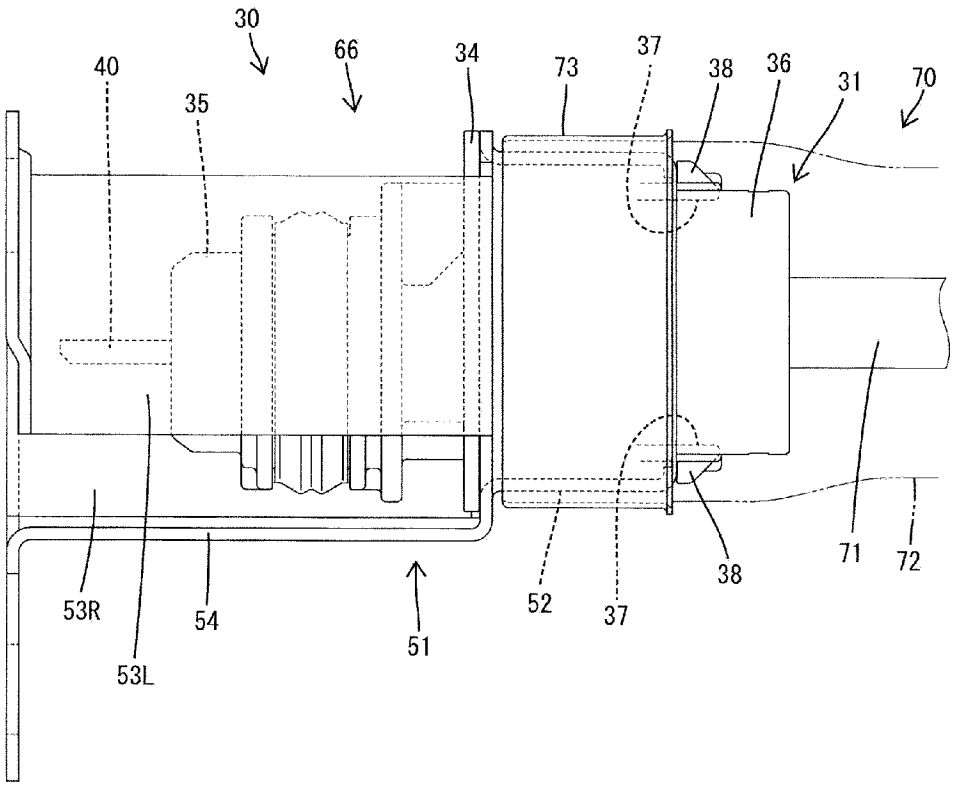
FIG. 9 is a side view of the harness-side connector.

The device-side shield shell 21 is a wide substantially flat rectangular plate that is integrated with the supporting wall 12 by insert molding and is substantially parallel to the supporting wall 12. An outer peripheral edge of the device-side shield shell 21 is exposed from the outer peripheral edge of the supporting wall 12. As shown in FIG. 7, four device-side lateral part connection holes 22 and one device-side bottom part connection hole 23 penetrate through the device-side shield shell 21 in the front-back direction. The device-side lateral part connection holes 22 are arranged on four corners (i.e. opposite left and right end parts) of the outer periphery of the device-side shield shell 21. The one device-side bottom part connection hole 23 is arranged in a lateral central part of a lower edge of the device-side shield shell 21.

Figure 3:
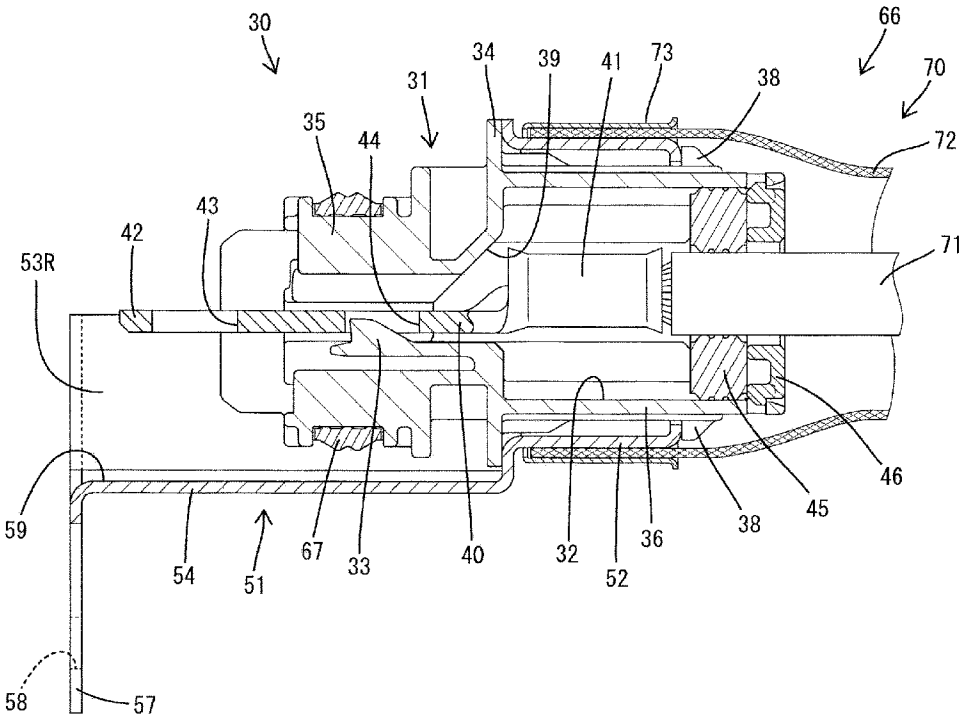
FIG. 3 is a side view in section of the harness-side connector.

As shown in FIGS. 1 and 3, the harness-side connector 30 is provided on an end of a wiring harness 70. The wiring harness 70 includes three wires 71 and a shield layer comprising a braided wire 72 collectively surrounding the three wires 71. The braided wire 72 is formed by braiding metal strands into a tubular shape and functions as a shield member. As shown in FIG. 1, the harness-side connector 30 includes the harness-side housing 31 made of synthetic resin, three harness-side terminals 40 and a harness-side shield shell 50 made of conductive material such as metal.

Figure 2:
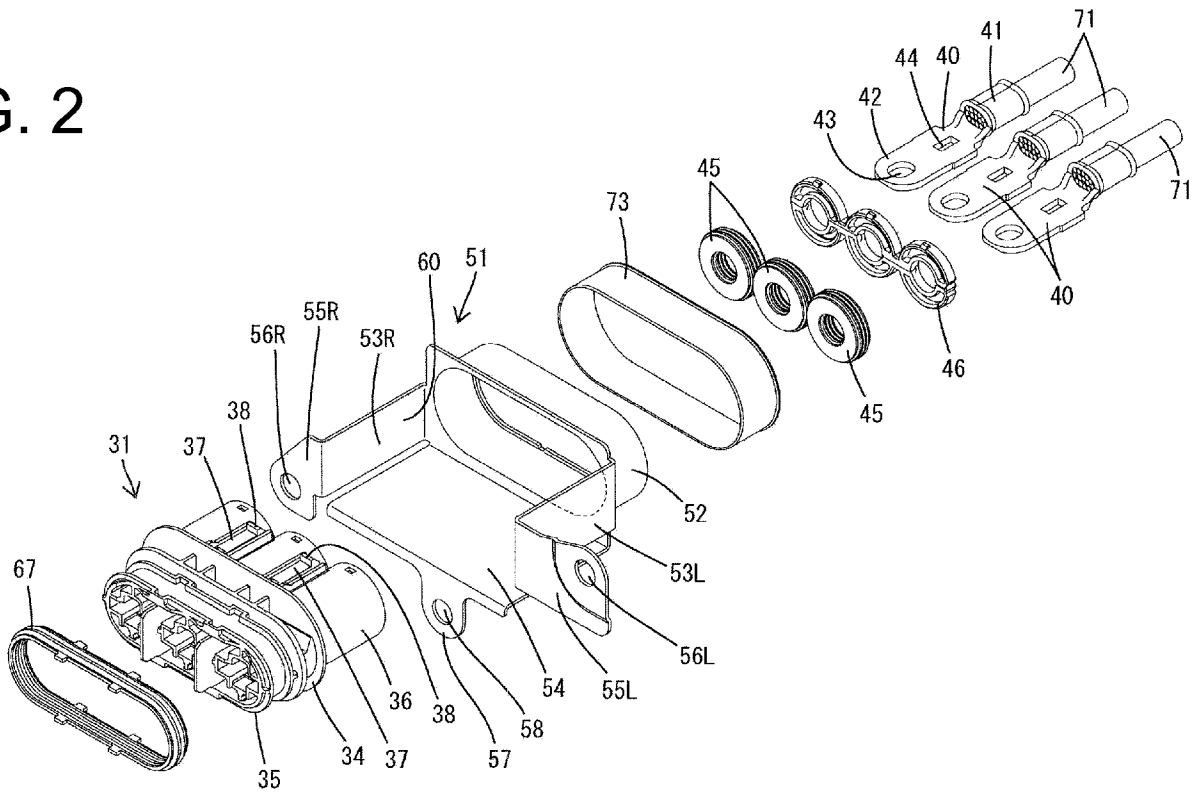
FIG. 2 is an exploded perspective view of a harness-side connector.

As shown in FIG. 2, the harness-side housing 31 has a wide substantially elliptical block-like outer shape. As shown in FIG. 3, three terminal accommodating chambers 32 are formed side by side in the lateral direction in the harness-side housing 31 and penetrate the harness-side housing 31 in the front-back direction. A locking lance 33 is formed in each terminal accommodating chamber 32. As shown in FIG. 2, a plate-like locking portion 34 projects in a flange-like manner over the entire periphery on the outer surface of the harness-side housing 31. An area of the harness-side housing 31 before the plate-like locking portion 34 (left side in FIGS. 2 and 3) defines a fitting 35 to be fit to a device-side harness and an area behind the plate-like locking portion 34 defines a shell mounting portion 36.

As shown in FIG. 4, the shell mounting portion 36 is formed with two pairs of resilient locking pieces 37. Two paired resilient locking pieces 37 are arranged separately on the upper and lower surfaces of the shell mounting portion 36. The resilient locking pieces 37 are arranged while being spaced apart in the lateral direction on each of the upper and lower surfaces of the shell mounting portion 36. Each resilient locking piece 37 is cantilevered back and is resiliently deflectable in directions toward and away from the outer surface of the shell mounting portion 36. A locking projection 38 projects toward a side (i.e. upper or lower side) opposite to the outer surface of the shell mounting portion 36 is formed on a rear extending end part of the resilient locking piece 37.

As shown in FIG. 2, the harness-side terminal 40 is long in the front-back direction and is narrow laterally. An end part of the wire 71 is fixed to a crimping portion 41 on a rear end part (right end in FIG. 3) of the harness-side terminal 40. A connecting portion 42 is formed at a front half area of the harness-side terminal 3*wq*40 and defines a narrow flat plate that is long in the front-back direction. A harness-side mounting hole 43 is formed on the connecting portion 42 and penetrates in a direction parallel to a plate thickness direction of the connecting portion 42. A locking hole 44 is formed at a position of the connecting portion 42 behind the harness-side mounting hole 43.

The harness-side terminal 40 is inserted into the terminal accommodating chamber 32 from behind the harness-side housing 31. As shown in FIG. 3, the harness-side terminal 40 inserted into the terminal accommodating chamber 32 is stopped in front by contact of the crimping portion 41 with a stopper 39 in the terminal accommodating chamber 32 and is retained by engagement of the locking hole 44 with the locking lance 33. Further, a clearance between the outer peripheral surface of the wire 71 and the inner peripheral surface of the terminal accommodating chamber 32 is sealed by a resilient or rubber plug 45 in a rear part of the terminal accommodating chamber 32. A rear holder 46 retains the rubber plug 45.

In this way, the harness-side terminals 40 are mounted in the harness-side housing 31 substantially side by side in the lateral direction with the plate surfaces thereof extending substantially horizontally. With the harness-side terminals 40 mounted in the harness-side housing 31, front end areas of the connecting portions 42 where the harness-side mounting holes 43 are formed project farther forward than the front end of the fitting portion 35.

As shown in FIGS. 1 and 2, the harness-side shield shell 50 comprises a first shell 51 and a second shell 61. Plates 53L, 53R are cantilevered forward from opposite left and right sides of an opening edge on the front end of the tubular portion 52 and a bottom plate 54 is cantilevered forward from a lower side of the opening edge on the front end of the tubular portion 52. A first left mounting plate 55L projects substantially perpendicularly leftward from the front end edge of the first left side plate 53L and a harness-side first left connection hole 56L penetrates therethrough in the front-back direction. A first right mounting plate 55R projects substantially perpendicularly rightward from the front end edge of the first right side plate 53R and a harness-side first right connection hole 56R penetrates therethrough in the front-back direction. A bottom mounting plate 57 projects substantially perpendicularly down from the front end edge of the bottom plate 54 and a harness-side bottom connection hole 58 penetrates therethrough in the front-back direction.

The fitting portion 35 and the connecting portions 42 of the harness-side terminals 40 are accommodated in a space enclosed by the first left side plate 53L, the first right side plate 53R and the bottom plate 54 of the first shell 51. The front surface of this space is open as a connection cutout 59 to avoid interference with the box-shaped portion 13 of the device-side housing 11 when the two housings 11, 31 are connected. The upper surface of the space is open as an operation cutout 60 and corresponds to the operation opening 16 of the box-shaped portion 13 when the device-side terminals 18 and the harness-side terminals 40 are connected using bolts.

As shown in FIG. 1, the second shell 61 includes an upper plate portion 62, a second left side plate 63L extending down substantially perpendicularly from the left edge of the upper plate 62 and a second right side plate 63R extending down substantially perpendicularly from the right edge of the upper plate 62. A second left mounting plate 64L projects left substantially perpendicularly from the front of the second left side plate 63L and a harness-side second left connection hole 65L penetrates therethrough in the front-back direction. A is formed on A second right mounting plate 64R projecting right substantially perpendicularly from the front of the second right side plate 63R and a harness-side second right connection hole 65R penetrates therethrough in the front-back direction.

A process of connecting the harness-side connector 30 to the device-side connector 10 may begin by detaching the cap 17 of the device-side connector 10 from the box-shaped accommodating portion 13 to open the operation opening 16. This enables the device-side mounting holes 19 of the device-side terminals 18 to be seen through the operation opening 16 when viewed from above.

The device-side terminals 18 connected to the wires 71 are mounted into the harness-side housing 31 and a front end part of the braided wire 72 is fixed to the tubular portion 52 of the first shell 51. A caulk ring 73 having a wide elliptical shape is fit externally on the braided wire 72 in advance and the front end part of the braided wire 72 is fit externally on the tubular portion 52. The caulk ring 73 then is slid forward to face the outer peripheral surface of the tubular portion 52. In this state, the caulk ring 73 is caulked and deformed to a reduced diameter and the front end part of the braided wire 72 is sandwiched between the outer periphery of the tubular portion 52 and the inner periphery of the caulk ring 73. In this way, the front end part of the braided wire 72 is fixed to the tubular portion 52 of the first shell 51.

The first shell 51 then is fit externally on the shell mounting portion 36 from behind the harness-side housing 31. In this process, the front end edge of the tubular portion 52 interferes with the locking projection 38. Thus, the resilient locking pieces 37 deflect resiliently toward the outer periphery of the shell mounting portion 36. The front end of the tubular portion 52 collides with the plate-like locking portion 34 from behind when the first shell 51 reaches an assembled position and is stopped with respect to the harness-side housing 31 so that the first shell 51 is stopped in front. Substantially simultaneously, the resilient locking pieces 37 restore resiliently as the tubular portion 52 passes over the locking projections 38 and the two pairs of locking projections 38 are locked to the tubular portion 52 from behind to retain the tubular portion 52.

In this way, the first shell 51 is held assembled with the harness-side housing 31 and the braided wire 72 is integrated with the first shell 51 and the harness-side housing 31 to form the harness-side connection unit 66, as shown in FIGS. 1, 3, 5 and 9. The second shell 61 is not yet mounted in this harness-side connection unit 66. Thus, the operation cutout 60 of the first shell 51 is open laterally (e.g. up) and the harness-side mounting holes 43 of the harness-side terminals 40 can be seen through the operation cutout 60 from above.

This harness-side connection unit 66 then is assembled with the device-side housing 11. During assembling, the harness-side connection unit 66 and the device-side housing 11 are brought closer together with their front surfaces facing each other. The connecting portions 42 of the harness-side terminals 40 then are accommodated into the terminal accommodation space 14 through the connection opening 15, and the fitting portion 35 is fit into the connection opening 15. A clearance between the outer periphery of the fitting portion 35 and the inner periphery of the connection opening 15 is sealed by a seal ring 67 externally fit on the fitting portion 35 in advance.

With the fitting portion 35 fit in the connection opening 15, the harness-side first left connection hole 56L of the first shell 51 is aligned substantially concentrically with the device-side lateral part connection hole on the right upper corner of the device-side shield shell 21. Further, the harness-side first right connection hole 56R of the first shell 51 is aligned substantially concentrically with the device-side lateral part connection hole 22 on the left lower corner of the device-side shield shell 21. Further, the first left and right side plates 53L, 53R and the bottom plate 54 of the first shell 51 at least partly cover outer surfaces of the box-shaped portion 13. The harness-side bottom part connection hole 58 of the first shell 51 then is aligned with the device-side bottom part connection hole 23 of the device-side shield shell 21. If a bolt 68 is inserted into the harness-side bottom part connection hole 58 and the device-side bottom part connection hole 23 and a nut (not shown) is screwed in this state, the two housings 11, 31 can be held connected.

The connecting portions 42 of the harness-side terminals 40 are arranged on the upper surfaces of the corresponding device-side terminals 18 and the harness-side mounting holes 43 are substantially concentric with the device-side mounting holes 19. These overlapping parts of the terminals 18, 40 and the aligned parts of the mounting holes 19, 43 can be seen from above through the operation opening 16 and the operation cutout 60. Further, bolts 69 and an impact wrench (not shown) can be inserted into the terminal accommodation space 14 through the operation opening 16 and the operation cutout 60.

The bolt 69 then is inserted into the terminal accommodation space 14 through the operation opening 16 and the operation cutout 60 and is screwed through the mounting holes 19, 43 and into the nut 20. The terminals 18, 40 are connected electrically by tightening the bolt 69 with an impact wrench. The first shell 51 fixed to the braided wire 72 is held mounted properly on the harness-side housing 31 during the connection of the terminals 18, 40 by the bolt 69. Thus, it is not necessary to deform the braided wire 72. Therefore, there is no possibility that an external force acts on the first shell 51 from the side of the braided wire 72 to hinder the operation of connecting the terminals 18, 40.

The cap 17 is fit to the operation opening 16 to close the operation opening 16 after the connection of all the terminals 18, 40. Thereafter, the second shell 61 is fitted to cover the first shell 51 from above, the upper surface of the box-shaped portion 13 is covered by the upper plate 62 and the second left side plate 63L is placed on the outer surface of the first left side plate 53L and the second right side plate 63R is placed on the outer surface of the first right side plate 53R. Then, the harness-side second left connection hole 65L is aligned with the harness-side first left connection hole 56L and the device-side lateral part connection hole 22 and the harness-side second right connection hole 65R is aligned with the harness-side first right connection hole 56R and the device-side lateral part connection hole 22.

Thereafter, the first and second shells 51, 61 are integrated to form the harness-side shield shell 50 and, simultaneously, the harness-side shield shell 50 and the device-side shield shell 21 are connected electrically conductively merely by tightening a nut (not shown) onto a bolt 68 inserted through the harness-side second right connection hole 65R, the harness-side first right connection hole 56R and the device-side lateral part connection hole 22 and tightening a nut (not shown) onto a bolt 68 inserted through the harness-side second left connection hole 65L, the harness-side first left connection hole 56L and the device-side lateral part connection hole 22.

The device connector of this embodiment includes the device-side housing 11 configured to hold the device-side terminals 18, the device-side shield shell 21 mounted on the device-side housing 11, the three wires 71 of the wiring harness 70, the harness-side terminals 40 fixed to the wires 71 and connected to the device-side terminals 18 by tightening the bolts 69, and the harness-side housing 31 connectable to the device-side housing 11 and configured to hold the harness-side terminals 40. The harness-side shield shell 50 surrounding the harness-side housing 31 is connected to the braided wire 72 formed by braiding the metal strands into a tubular shape and surrounding the three wires 71.

This harness-side shield shell 50 includes the first shell 51 fixed to the braided wire 72 and including the operation cutout 60 for enabling the connecting operation of the device-side terminals 18 and the harness-side terminals 40 by the bolts, and the second shell 61 mounted on the first shell 51 and the device-side shield shell 21 while closing the operation cutout 60.

The harness-side housing 31 is connected to the device-side housing 11 before connecting the device-side terminals 18 and the harness-side terminals 40. The first shell 51 is arranged to correspond to the harness-side housing 31 so that the braided wire 72 is not deformed forcibly. The second shell 61 is detached in this state so that the operation cutout 60 is open. The bolts 69 then are tightened in the operation cutout 60 for connecting the harness-side terminals 40 to the device-side terminals 18. The second shell 61 then is mounted to close the operation cutout 60 after the harness-side terminals 40 and the device-side terminals 18 are connected so that a shielding function is maintained. The braided wire 72 need not be deformed forcibly when connecting the harness-side terminals 40 and the device-side terminals 18 by the bolts 69. Thus, operability is good when connecting the device-side terminals 18 and the harness-side terminals 40 by the bolts 69.

The device connector has the plate-like locking portion 34 and resilient locking pieces 37 on the harness-side housing 31 to hold the first shell 51 assembled with the harness-side housing 31. Thus an operation of connecting the harness-side housing 31 to the device-side housing 11 and an operation of arranging the first shell 51 at a position connectable to the device-side shield shell 21 can be performed in one action.

The device connector includes the device-side bottom part connection hole 23 and harness-side bottom part connection hole 58 to fix the first shell 51 and the device-side shield shell 21 in a state where the harness-side housing 31 is connected to the device-side housing 11 and the second shell 61 is detached from the first shell 51. According to this configuration, there is no possibility of hindering the connecting operation of the device-side terminals 18 and the harness-side terminals 40 since the harness-side housing 31 and the device-side housing 11 are held connected while connecting the terminals 18, 40.

The invention is not limited to the above described embodiment. For example, the following embodiments also are in the scope of the invention.

Although a holding portion for holding the first shield member assembled with the harness-side housing is formed in the above embodiment, such a holding portion may not be formed.

Although the first shell is fixed to the device-side shield shell with the second shell detached from the first shell in the above embodiment, the first shell may be fixed indirectly to the device-side shield shell via the second shell without providing means for directly fixing the first shell and the device-side shield shell.

Although the first and second shells are fastened together to the device-side shield shell in the above embodiment, the first and second shells may be separately fixed to the device-side shield shell.

The wires 71 are shielded by a braided wire 72 in the above embodiment. However, any other shielding layer may be used in connection with the invention such as a conductive sheath (e.g. in the form of a metallic flexible film) at least partly wrapped around the wires 71 to provide shielding functionality.

REFERENCE SIGNS

11 . . . device-side housing
18 . . . device-side terminal
21 . . . device-side shield shell
31 . . . harness-side housing
40 . . . harness-side terminal
50 . . . harness-side shield shell
51 . . . first shell
60 . . . operation cutout
61 . . . second shell
69 . . . bolt
70 . . . wiring harness
71 . . . wire
72 . . . braided wire (shielding layer)

What is claimed is:

1. A device connector, comprising:

a device-side housing configured to hold one or more device-side terminals;

a device-side shield shell to be mounted on the device-side housing one or more harness-side terminals to be fixed to one or more wires of a wiring harness and to be connected to device-side terminals a harness-side housing connectable to the device-side housing and configured to hold the one or more harness-side terminals a harness-side shield shell connectable to a shielding layer at least partly surround the one or more wires the harness-side shield shell being configured to at least partly surround the harness-side housing and including:

a first shell to be connected to the shielding layer and including at least one operation cutout for enabling a connecting operation of the device-side terminals and the harness-side terminals and a second shell to be mounted on the first shell and the device-side shield shell while at least partly closing the operation cutout.

2. The device connector of claim 1, wherein the one or more harness-side terminals are to be connected to the respective device-side terminals by tightening one or more bolts.

3. The device connector of claim 2, wherein the at least one operation cutout enables the connecting operation of the device-side terminals and the harness-side terminals by the one or more bolts.

4. The device connector of claim 1, wherein the shielding layer comprises at least one braided wire formed by braiding metal strands substantially into a tubular shape.

5. The device connector of claim 1, wherein the first shell is fixed to the shielding layer.

6. The device connector of claim 1, further comprising means formed on the harness-side housing and configured to hold the first shell assembled with the harness-side housing.

7. The device connector of claim 1, wherein the first shell and the device-side shield shell include means for fixing the first shell and the device-side shield shell in a state where the harness-side housing is connected to the device-side housing and the second shell is detached from the first shell.

* * * * *